US007168962B2

(12) United States Patent
Yomura

(10) Patent No.: US 7,168,962 B2
(45) Date of Patent: Jan. 30, 2007

(54) ELECTRIC JUNCTION BOX FOR A VEHICLE

(75) Inventor: Takeshi Yomura, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 11/212,721

(22) Filed: Aug. 29, 2005

(65) Prior Publication Data

US 2006/0046536 A1 Mar. 2, 2006

(30) Foreign Application Priority Data

Aug. 31, 2004 (JP) ..... 2004-252955

(51) Int. Cl.
*H01R 12/00* (2006.01)

(52) U.S. Cl. ..... 439/76.2

(58) Field of Classification Search ..... 439/76, 439/181, 620, 366–367, 144, 147; 174/50.52; 219/504; 338/7, 22 R, 59; 361/822, 823, 361/826

See application file for complete search history.

(56) References Cited

U.S. PATENT DOCUMENTS 5,645,746 A * 7/1997 Walsh ..... 219/505
5,793,277 A * 8/1998 Ichikawa et al. ..... 338/22 R
5,892,413 A * 4/1999 Okimura ..... 333/100
6,215,636 B1 * 4/2001 Hellemans ..... 361/104
6,225,610 B1 * 5/2001 Walsh ..... 219/505
6,283,769 B1 9/2001 Asao et al.
6,659,783 B2 * 12/2003 Copper et al. ..... 439/181
6,712,623 B2 3/2004 Sumida

FOREIGN PATENT DOCUMENTS

JP 6-45287 6/1994

* cited by examiner

*Primary Examiner*—J. F. Duverne
(74) *Attorney, Agent, or Firm*—Greenblum & Bernstein, P.L.C.

(57) ABSTRACT

An electric junction box for use in either a right hand drive vehicle or a left hand drive vehicle. Fuse replacements of the electric junction box are performed through a fuse-replacement opening provided on the vehicle-body side. The electric junction box includes a plurality of fuse-connecting units provided on the case of the electric junction box. The plurality of fuse-connecting units include shared fuse-connecting units located in a middle region among the plurality of fuse-connecting units, fuse-connecting units for a right hand drive vehicle and fuse-connecting units for a left hand drive vehicle. The shared fuse-connecting units aligned with the fuse-replacement opening whether the electric junction box is installed in a right hand drive vehicle or a left hand drive vehicle.

5 Claims, 14 Drawing Sheets

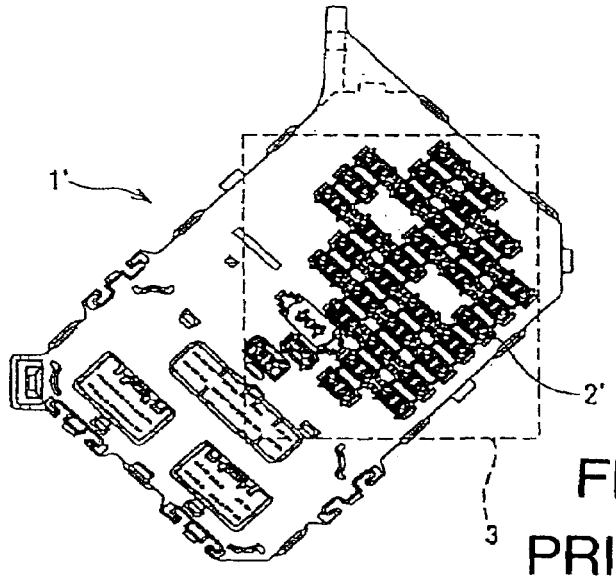
FIG.14
PRIOR ART
FIG.15B
PRIOR ART
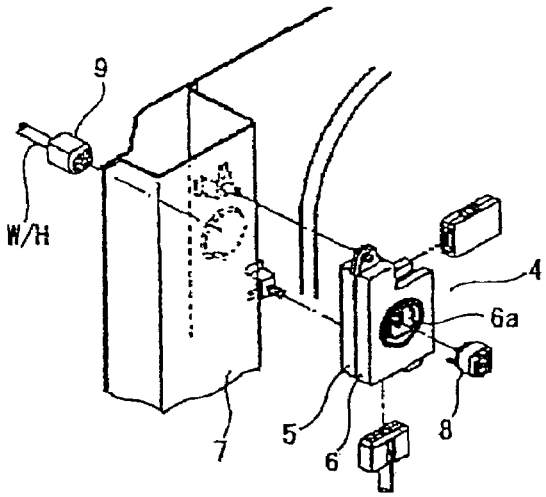
FIG.15A
PRIOR ART
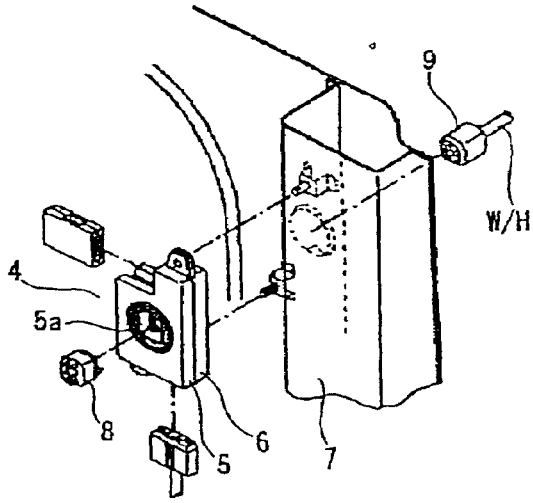

ELECTRIC JUNCTION BOX FOR A VEHICLE

CROSS-REFERENCE TO RELATED APPLICATIONS

The present disclosure relates to subject matter contained in priority Japanese Application No. 2004-252955, filed on Aug. 31, 2004, which is herein expressly incorporated by reference in its entirety.

BACKGROUND OF THE INVENTION

1. Field of the Invention

The present invention relates to an electric junction box for installation in a vehicle. More particularly, the electric junction box can be used in both a right hand drive vehicle (a vehicle having the steering wheel on the right side) and a left hand drive vehicle (a vehicle having the steering wheel on the left side). Fuse replacements for the electric junction box are performed through fuse-replacement openings which have the same shape and are provided at locations symmetrically left to right to each other in a right hand drive vehicle and a left hand drive vehicle.

2. Description of Related Art

Conventionally, an electric junction box for installation in a vehicle has fuse-connecting units formed on an external surface of the case of the electric junction box. When a fuse fitted in a fuse-connecting unit is melted (shorted) due to a high current condition, the melted fuse is replaced through a fuse-replacement opening provided on the body-side of the vehicle. For such an electric junction box, the following problem exists. When a fuse is replaced through the fuse-replacement opening which has the same shape and is provided at symmetric locations in a right hand drive vehicle and a left hand drive vehicle, in order to provide the fuse-connecting units in a location aligned with the fuse-replacement opening, it is necessary to provide separately an electric junction box for installation in a right hand drive vehicle and an electric junction box for installation in a left hand drive vehicle, in which the fuse-connecting units are provided at different locations.

More particularly, as shown in FIG. 13(A), when electric junction box 1 for installation in a right hand drive vehicle is installed at a predetermined location in a right hand drive vehicle, fuse-connecting units 2 are provided in electric junction box 1 at a location aligned with fuse-replacement opening 3. However, as shown in FIG. 13(B), when electric junction box 1 for installation in a right hand drive vehicle is installed at a predetermined location in a left hand drive vehicle, some of fuse-connecting units 2A are not provided in a location aligned with fuse-replacement opening 3 so that fuse replacements cannot be performed through fuse-replacement opening 3. Therefore, electric junction box 1' for installation in a left hand drive vehicle is provided, in which the location of the fuse-connecting units is changed as compared to electric junction box 1 for installation in a right hand drive vehicle. As shown in FIG. 14, when electric junction box 1' is installed in a left hand drive vehicle, all fuse-connecting units 2' are provided in a location aligned with fuse-replacement opening 3.

In order to eliminate the problem of having to provide separately an electric junction box for installation in a right hand drive vehicle and an electric junction box for installation in a left hand drive vehicle, in Japanese Laid Open Utility Model Publication H6-45287, as shown in FIG. 15, electric junction box 4 that can be used for installation in both a right hand drive vehicle and a left hand drive vehicle has been disclosed. On upper case 5 and lower case 6 of electric junction box 4, connector units 5*a* and 6*a*, respectively, having the same shape and configuration, are provided. As FIG. 15(A) shows, when electric junction box 4 is installed in a right hand drive vehicle, lower case 6 is placed on the dashboard 7 side, fuse-holder 8 is mounted in connector unit 5*a* on upper case 5 so that fuse-connecting units are provided on the passenger compartment side, and connector 9 of a terminal of wire harness W/H is fitted from the front-side of the vehicle in connector 6*a* on lower case 6. On the other hand, as shown in FIG. 15(B), when electric junction box 4 is installed in a left hand drive vehicle, by turning electric junction box 4 over, upper case 5 is placed on the dashboard 7 side, fuse-holder 8 is mounted in connector unit 6*a* on lower case 6 so that fuse-connecting units are formed on the passenger compartment side, and connector 9 of the terminal of wire harness W/H is fitted in connector 5*a* on upper case 5.

In the above-described electric junction box 4 of the prior art of JP H6-45287, the fuse-connecting units are provided by using fuse-holder 5, which is a separate part from electric junction box 4, so that the fuse-connecting units can be provided on the passenger compartment side even when electric junction box 4 is installed with upper and lower sides reversed. However, since electric junction box 4 and fuse-holder 5 are provided separately, there is a problem that the number of parts and the number of worker-hours are increased. Further, when there is a mismatch in the relative positions of the fuse-replacement opening in a right hand drive vehicle and a left hand drive vehicle, there is a problem that it may be not possible to provide the fuse-connecting units in a location aligned with the fuse-replacement opening.

SUMMARY OF THE INVENTION

The present invention is provided to solve at least above-described problems. An objective of the present invention is to provide an electric junction box that can be used in both a right hand drive vehicle and a left hand drive vehicle. Fuse replacements for the electric junction box are performed through fuse-replacement openings which have the same shape and are provided at locations symmetrical left to right in a right hand drive vehicle and a left hand drive vehicle.

An aspect of the present invention provides an electric junction box for a right hand drive vehicle or a left hand drive vehicle, the electric junction box including a case; and a plurality of fuse-connecting units provided on the case, the plurality of fuse-connecting units including shared fuse-connecting units provided in a middle region of the case among the plurality of fuse-connecting units; fuse-connecting units for a right hand drive vehicle; and fuse-connecting units for a left hand drive vehicle; wherein fuse replacements may be performed through a fuse-replacement opening in the vehicle, the fuse-replacement opening in a right hand drive vehicle and the fuse-replacement opening in a left hand drive vehicle having the same shape and being provided at locations symmetrical left to right.

Further, the shared fuse-connecting units are provided in alignment with the fuse-replacement opening whether the electric junction box is installed in a right hand drive vehicle or a left hand drive vehicle. Additionally, the fuse-connecting units for a right hand drive vehicle are provided in alignment with the fuse-replacement opening only when the electric junction box is provided in a right hand drive vehicle. The fuse-connecting units for a left hand drive vehicle are provided in alignment with the fuse-replacement opening only when the electric junction box is provided in a left hand drive vehicle.

Further, the combination of the shared fuse-connecting units and the fuse-connecting units for a right hand drive vehicle forms a first group of fuse-connecting units required for a right hand drive vehicle; and the combination of the shared fuse-connecting units and the fuse-connecting units for a left hand drive vehicle forms a second group of fuse-connecting units required for a left hand drive vehicle. The fuse-connecting units for a right hand drive vehicle and the fuse-connecting units for a left hand drive vehicle are provided symmetrically left to right with respect to the shared fuse-connecting units located in the middle region; and the number (A) of the shared fuse-connecting units and the number (B) of fuse-connecting units for either a right hand drive vehicle or a left hand drive vehicle are such that the ratio A:B is in the range 5:5–7:3. Further, all fuse-connecting terminals of an internal circuit contained inside the case project into all fuse-connecting terminal receptacles of the fuse-connecting units of the first group and the second group, the fuse-connecting terminal receptacles being provided on the inner surface of the case; fuse-mounting portions are provided on the external surface of the case and are each linked to a corresponding fuse-connecting terminal receptacle; for a right hand drive vehicle, the fuse-mounting portions are provided only for the shared fuse-connecting units and the fuse-connecting units for a right hand drive vehicle, and are not provided for the fuse-connecting units for a left hand drive vehicle so that the corresponding area on the external surface of the case forms a closed surface; and for a left hand drive vehicle, the fuse-mounting portions are provided only for the shared fuse-connecting units and the fuse-connecting units for a left hand drive vehicle, and are not provided for the fuse-connecting units for a right hand drive vehicle so that the corresponding area on the external surface of the case forms a closed surface. All fuse-connecting terminals of an internal circuit contained inside the case project into all fuse-connecting terminal receptacles of the fuse-connecting units of the first group and the second group, the fuse-connecting terminal receptacles being provided on the inner surface of the case; fuse-mounting portions are provided for all fuse-connecting units of the first group and the second group on the external surface of the case and are linked to the fuse-connecting terminal receptacles, respectively; and fuse connectors and/or joint-connectors are mounted in the fuse-mounting portions for a left hand drive vehicle when the junction box is for installation in a right hand drive vehicle or in the fuse-mounting portions for a right hand drive vehicle when the junction box is for installation in a left hand drive vehicle, each of the fuse connectors having electric wires connected to input and output terminals of a fuse, each of the joint-connectors including a joint bus bar, the joint bus bar having branched projecting connection pins, each of the connection pins connecting to a fuse-connecting terminal.

According to the configuration described above, by providing the shared fuse-connecting units, the fuse-connecting units for a right hand drive vehicle and the fuse-connecting units for a left hand drive vehicle on the case of the electric junction box, when the electric junction box is installed in a right hand drive vehicle, fuses are mounted in the fuse-connecting units of the first group, which includes the shared fuse-connecting units and the fuse-connecting units for a right hand drive vehicle, and all of the fuses are placed in a location facing the fuse-replacement opening. Therefore, when a fuse melts down, the fuse can be replaced through the fuse-replacement opening. Similarly, when the electric junction box is installed in a left hand drive vehicle, fuses are mounted in the fuse-connecting units of the second group, which includes the shared fuse-connecting units and the fuse-connecting units for a left hand drive vehicle, and all of the fuses are placed in a location facing the fuse-replacement opening so that a melted fuse can be replaced through the fuse-replacement opening. Except when replacing a fuse, the fuse-replacement opening is covered with a cover and is closed.

As described above, by providing the fuse-connecting units of the first group and the fuse-connecting units of the second group on the case of one electric junction box, no matter the electric junction box is installed in a right hand drive vehicle or a left hand drive vehicle, it is possible to place fuses mounted in the fuse-connecting units in a location facing the fuse-replacement opening provided on the vehicle-body side and to replace melted-down fuses through the fuse-replacement opening. Consequently, the electric junction box can be used in both a right hand drive vehicle and a left hand drive vehicle, and there is no need to provide separately an electric junction box specific for a right hand drive vehicle and an electric junction box specific for a left hand drive vehicle, thereby making it possible to reduce the number of parts.

Further, since the internal circuit of the electric junction box is also used in both a right hand drive vehicle and a left hand drive vehicle, a shared circuitry for both a right hand drive vehicle and a left hand drive vehicle, a circuitry for a right hand drive vehicle and a circuitry for a left hand drive vehicle are all contained inside one case.

The electric junction box is placed slightly to the right-side of the fuse-replacement opening when installed in a right hand drive vehicle, and slightly to the left-side of the fuse-replacement opening when installed in a left hand drive vehicle. Consequently, the shared fuse-connecting units are provide in the middle region along the left-right direction; the fuse-connecting units for a right hand drive vehicle are placed to the left of the shared fuse-connecting units; and the fuse-connecting units for a left hand drive vehicle are placed to the right of shared fuse-connecting units. In other words, the fuse-connecting units for a right hand drive vehicle and the fuse-connecting units for a left hand drive vehicle are located left-right symmetrically with respect to the shared fuse-connecting units located in the middle region, and the required fuse-connecting units are placed in the location facing the fuse-replacement opening. Further, the number (A) of the shared fuse-connecting units and the number (B) of fuse-connecting units for either a right hand drive vehicle or a left hand drive vehicle are such that the ratio A:B is in the range 5:5–7:3 so that more than half of the fuses are fitted in the shared fuse-connecting units. Consequently, there are not too many fuses fitted in the fuse-connecting units for either a right hand drive vehicle or a left hand drive vehicle, and there are also not too many fuse-connecting units that are not used to connect with fuse terminals. Therefore, there is no significant waste occurring in the internal circuit, and there is also no significant increase in the size of the electric junction box.

All fuse-connecting terminals of an internal circuit contained inside the case project into all fuse-connecting terminal receptacles of the fuse-connecting units of the first group and the second group, the fuse-connecting terminal receptacles being provided on the inner surface of the case. Fuse-mounting portions are provided on the external surface of the case and are each linked to a corresponding fuse-connecting terminal receptacle. It is preferred that, when the electric junction box is for installation in a right hand drive vehicle, the fuse-mounting portions are provided only for the shared fuse-connecting units and the fuse-connecting units for a right hand drive vehicle, and are not provided for the fuse-connecting units for a left hand drive vehicle so that the corresponding area on the external surface of the case forms a closed surface area, and, when the electric junction box is for installation in a left hand drive vehicle, the fuse-mounting portions are provided only for the shared fuse-connecting units and the fuse-connecting units for a left hand drive vehicle, and are not provided for the fuse-connecting units for a right hand drive vehicle so that the corresponding area on the external surface of the case forms a closed surface area.

In other words, only for the case of the electric junction box, one specific for a right hand drive vehicle and one specific for a left hand drive vehicle are provided separately. On the case specific for a right hand drive vehicle, each of the shared fuse-connecting units and the fuse-connecting units for a right hand drive vehicle is formed by a fuse-mounting portion provided on the external surface of the case and a fuse-connecting terminal receptacle on the inner surface of the case, while each of the fuse-connecting units for a left hand drive vehicle is formed by only a fuse-connecting terminal receptacle provided on the inner surface of the case, and no fuse-mounting portion is provided on the external surface of the case. Similarly, on the case specific for a left hand drive vehicle, each of the shared fuse-connecting units and the fuse-connecting units for a left hand drive vehicle is formed by a fuse-mounting portion provided on the external surface of the case and a fuse-connecting terminal receptacle on the inner surface of the case, while each of the fuse-connecting units for a right hand drive vehicle is formed by only a fuse-connecting terminal receptacle provided on the inner surface of the case, and no fuse-mounting portion is provided on the external surface of the case.

According to the configuration described above, for the fuse-connecting units for a left hand drive vehicle that are not used in an electric junction box for installation in a right hand drive vehicle, or for the fuse-connecting units for a right hand drive vehicle that are not used in an electric junction box for installation in a left hand drive vehicle, no fuse-mounting portions are provided and the corresponding area on the case forms a closed surface area. Therefore, it is possible to prevent accidentally fitting a fuse in a fuse-connecting unit that is not used. Although differently shaped cases are provided for a right hand drive vehicle and a left hand drive vehicle, the only difference is the existence or nonexistence of some of the fuse-mounting portions on the external surfaces of the cases. Therefore, by placing a bushing in a case-forming die, the same die can be used to form both the case for a right hand drive vehicle and the case for a left hand drive vehicle, thereby reducing die costs. Further, on the inner surface of the case for a right hand drive vehicle and on the inner surface of the case for a left hand drive vehicle, fuse-connecting terminal receptacles for all fuse-connecting units are provided, and all fuse-connecting terminals of the internal circuit are fitted in the fuse-connecting terminal receptacles. Therefore, there is no need to change the internal circuit for a right hand drive vehicle and a left hand drive vehicle. Except the case, on which the fuse-mounting portions are provided, the electric junction box can be used in both a right hand drive vehicle and a left hand drive vehicle.

Further, all fuse-connecting terminals of an internal circuit contained inside the case project into all fuse-connecting terminal receptacles of the fuse-connecting units of the first group and the second group, the fuse-connecting terminal receptacles being provided on the inner surface of the case. Fuse-mounting portions are provided for all fuse-connecting units of the first group and the second group on the external surface of the case and are linked to the fuse-connecting terminal receptacles, respectively. Fuse connectors and/or joint-connectors may be mounted in the fuse-mounting portions for a left hand drive vehicle when the junction box is for installation in a right hand drive vehicle or in the fuse-mounting portions for a right hand drive vehicle when the junction box is for installation in a left hand drive vehicle, each of the fuse connectors having electric wires connected to input and output terminals of a fuse, each of the joint-connectors including a joint bus bar, the joint bus bar having branched projecting connection pins, each of the connection pins connecting to a fuse-connecting terminal.

According to the configuration described above, by fitting the fuse connectors into fuse-mounting portions linked to the fuse-connecting terminal receptacles containing fuse-connecting terminals that are not in use, fuse-connecting terminals are connected to electric wires of an external circuit; and similarly, by fitting the joint-connectors, the fuse-connecting terminals can be connected to each other to form a different circuit; thereby making it possible to make effective use of the fuse-connecting terminals that are not used to connect fuses.

As described above, according to the present invention, by providing the shared fuse-connecting units, the fuse-connecting units for a right hand drive vehicle and the fuse-connecting units for a left hand drive vehicle on the case of the electric junction box, no matter the electric junction box is for installation in a right hand drive vehicle or a left hand drive vehicle, it is possible to place fuses mounted in the required fuse-connecting units in a location facing the same fuse-replacement opening formed on the vehicle-body side and to replace melted-down fuses through the fuse-replacement opening. Consequently, the electric junction box can be used in both a right hand drive vehicle and a left hand drive vehicle, and there is no need to provide separately an electric junction box specific for a right hand drive vehicle and an electric junction box specific for a left hand drive vehicle, thereby making it possible to reduce the number of parts.

Among the fuse-connecting units for a left hand drive vehicle and the fuse-connecting units for a right hand drive vehicle, those fuse-connecting units that are not used have no fuse-mounting portions and are closed. Therefore, it is possible to prevent accidentally fitting a fuse in a fuse-connecting unit for a left hand drive vehicle in the electric junction box for installation in a right hand drive vehicle, or to prevent accidentally fitting a fuse in a fuse-connecting unit for a right hand drive vehicle in the electric junction box for installation in a left hand drive vehicle.

Further, by fitting fuse connectors into the fuse-connecting units for a left hand drive vehicle in the electric junction box for installation in a right hand drive vehicle or into fuse-connecting units for a right hand drive vehicle in the electric junction box for installation in a left hand drive vehicle, the fuse-connecting terminals are connected to electric wires of an external circuit. Similarly, by fitting joint-connectors, the fuse-connecting terminals are connected to each other to form a different circuit. Therefore, fuse-connecting terminals that are not used to connect fuse terminals can be used effectively.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which:

FIG. 14 shows a conventional electric junction box for left hand drive vehicles installed in a left hand drive vehicle; and FIG. 15A shows a conventional electric junction box installed in a right hand drive vehicle; and FIG. 15B shows a conventional electric junction box installed in a left hand drive vehicle.

DETAILED DESCRIPTION OF PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1A:
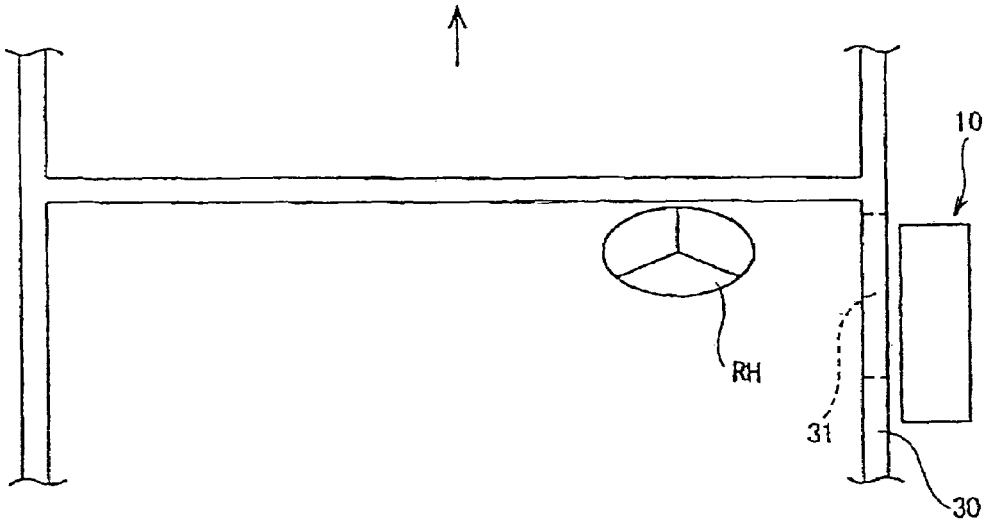
FIG. 1A is a schematic view showing an installation of the electric junction box of the present invention in a right hand drive vehicle.
Figure 1B:
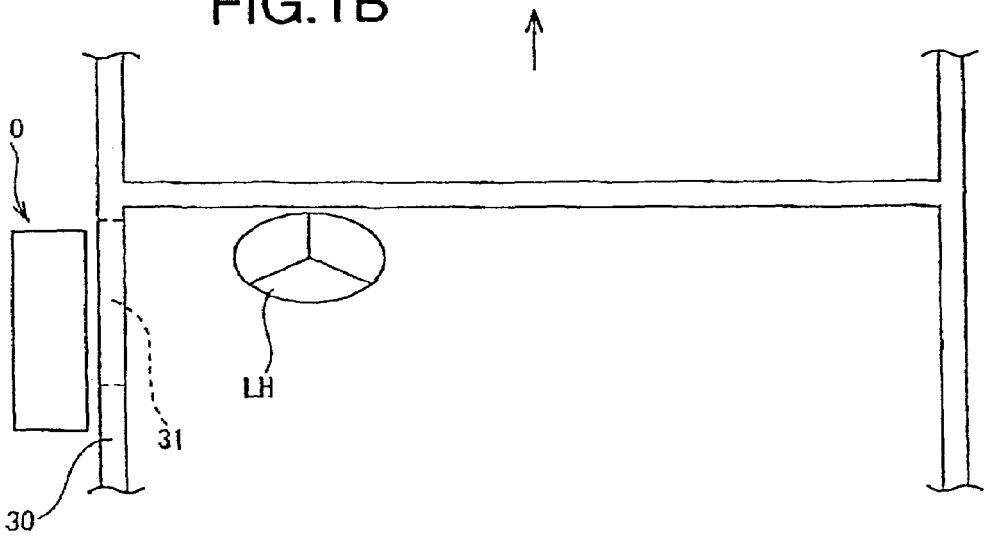
FIG. 1B is a schematic view showing an installation of the electric junction box of the present invention in a left hand drive vehicle.
Figure 2:
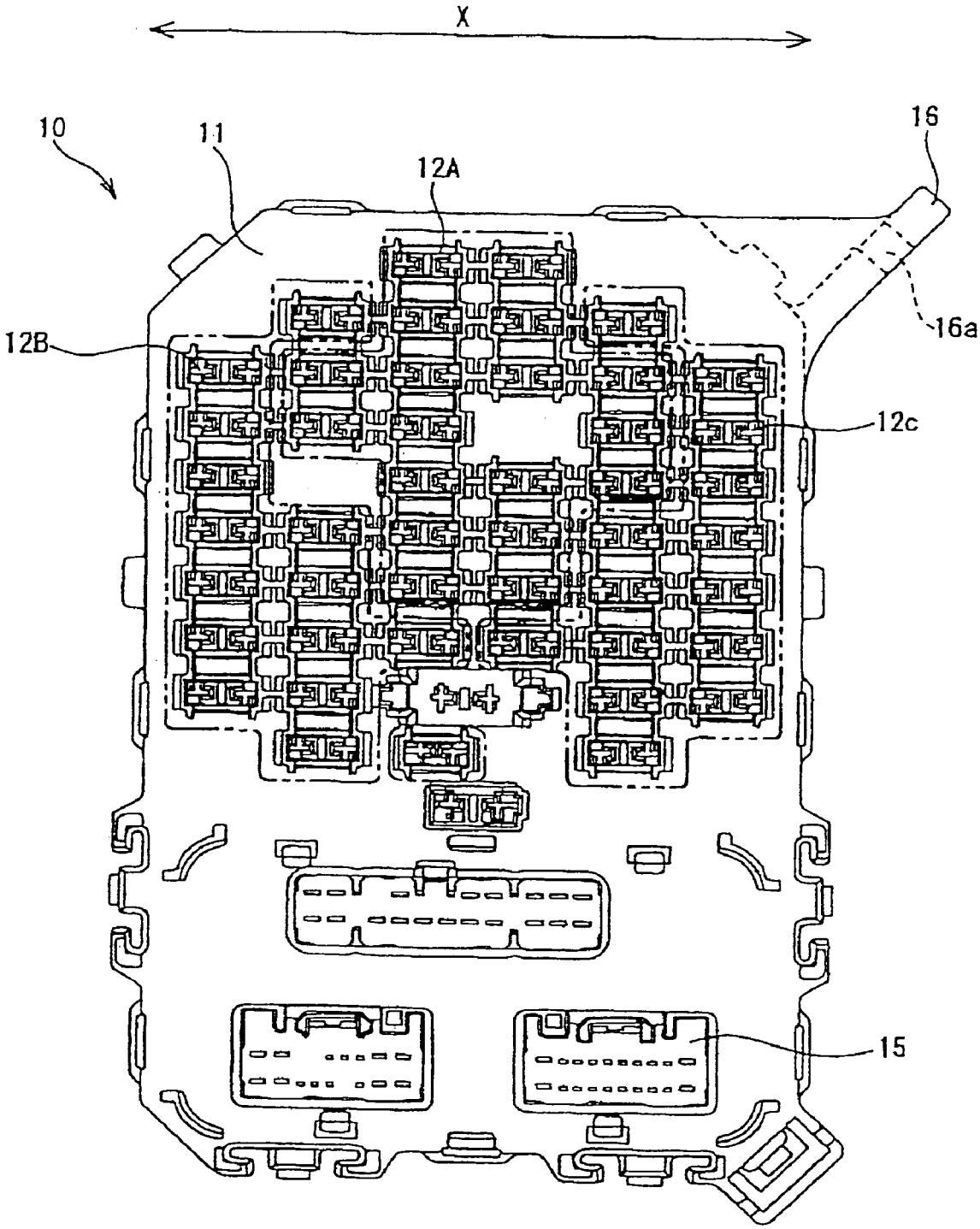
FIG. 2 is a plan view of an electric junction box according to a first embodiment of the present invention.

The following describes preferred embodiments of the present invention with reference to the drawings. The first embodiment of the present invention is shown in FIGS. 1–6. Electric junction box 10 may be used in both right hand drive vehicles and left hand drive vehicles, and may be installed at a location near the driver's feet. When electric junction box 10 is installed in a right hand drive vehicle (right hand drive RH), as FIG. 1A shows, electric junction box 10 is positioned slightly to the rear-side of fuse-replacement opening 31 formed on a body-panel of the vehicle (to the right-side when viewed from the front of the fuse-replacement opening). On the other hand, when electric junction box 10 is installed in a left hand drive vehicle (left hand drive LH), as FIG. 1B shows, electric junction box 10 is positioned slightly to the rear-side of fuse-replacement opening 31 (to the left-side when viewed from the front of the fuse-replacement opening). In other words, when installed in a right hand drive vehicle or a left hand drive vehicle, electric junction box 10 is displaced along the right-left direction relative to fuse-replacement opening 31.

Electric junction box 10 includes upper case 11 and a lower case (not shown in the figures), which are joined by locking joints. Laminate 20, which is formed by alternatively laminating a plurality of bus bars and a plurality of insulation plates, is contained in the case as internal circuits, the bus bars being made of conductive metal plates. The internal circuits of electric junction box 10 include all of the circuit patterns that can be used in both a right hand drive vehicle and a left hand drive vehicle, the circuit patterns for a right hand drive vehicle, and the circuit patterns for a left hand drive vehicle.

Upper case 11 includes upper wall 11*a* and peripheral wall 11*b*. A plurality of fuse-connecting units 12 are formed integrally on upper wall 11*a*. Fuse-connecting units 12 include shared fuse-connecting units 12A in the middle region along the left-right direction (inside the single-dotted line in FIG. 2), fuse-connecting units 12B for a right hand drive vehicle to the left of shared fuse-connecting units 12A in FIG. 2 (inside the double-dotted line in FIG. 2), and fuse-connecting units 12C for a left hand drive vehicle to the right of shared fuse-connecting units 12A in FIG. 2 (inside the triple-dotted line in FIG. 2). In other words, fuse-connecting units 12B for a right hand drive vehicle and fuse-connecting units 12C for a left hand drive vehicle are located symmetrically left to right with respect to shared fuse-connecting units 12A located in the middle region of the upper case 11. In an embodiment of the present invention, the number (A) of shared fuse-connecting units 12A is 19, and the number (B) of fuse-connecting units in each group of fuse-connecting units 12B for a right hand drive vehicle and fuse-connecting units 12C for a left hand drive vehicle is 14. The ratio A:B is kept in the range 5:5–7:3. Further, on upper case 11, members such as, for example, a connector-receptacle 15 are provided on the external surface of upper wall 11*a*, and bracket 16, on which bolt hole 16*a* is formed, is provided in a projecting condition on the external surface of peripheral wall 11*b*.

Figure 3:
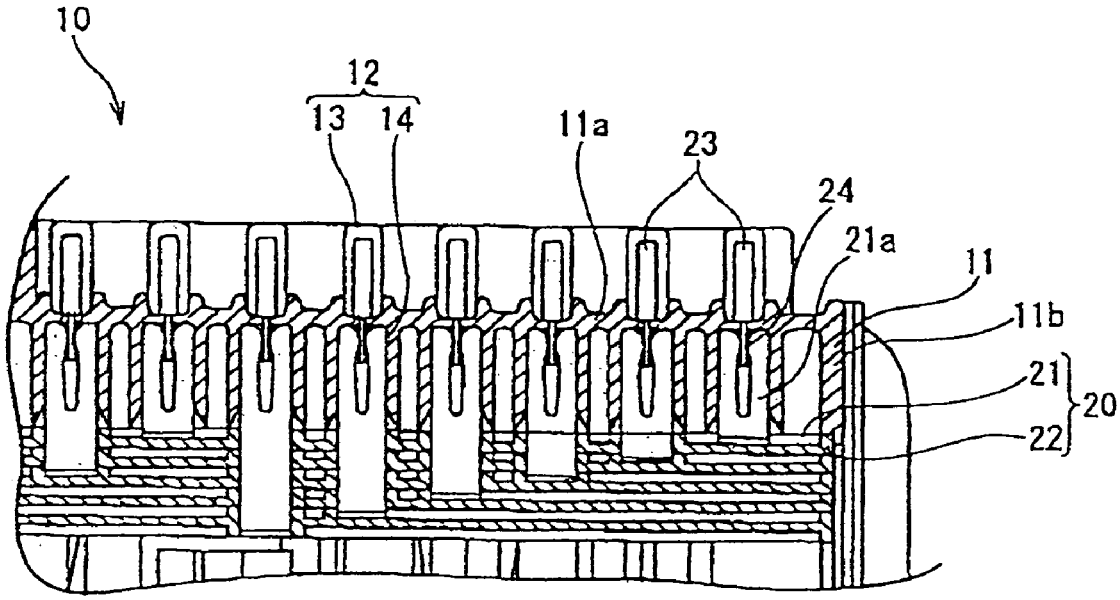
FIG. 3 is cross-sectional view of fuse-connecting units of the electric junction box of FIG. 2.

As FIG. 3 shows, each fuse-connecting unit 12 includes fuse-mounting portion 13 formed on the external surface of upper wall 11*a* of upper case 11 and fuse-connecting terminal receptacle 14 formed on the inner surface of upper wall 11*a* of upper case 11. Respective fuse-mounting portions 13 and fuse-connecting terminal receptacles 14 are linked to each other. In each fuse-connecting terminal receptacle 14, fuse-connecting terminal 21*a* projects upwardly. Fuse-connecting terminal 21*a* is formed in the shape of a tuning-fork on the tip of bus bar 21, which bends upwardly. By mounting fuse 23 in a fuse-mounting portion 13, input/output terminal 24 of fuse 23 is connected to fuse-connecting terminal 21*a* of the internal circuits.

Figure 4:
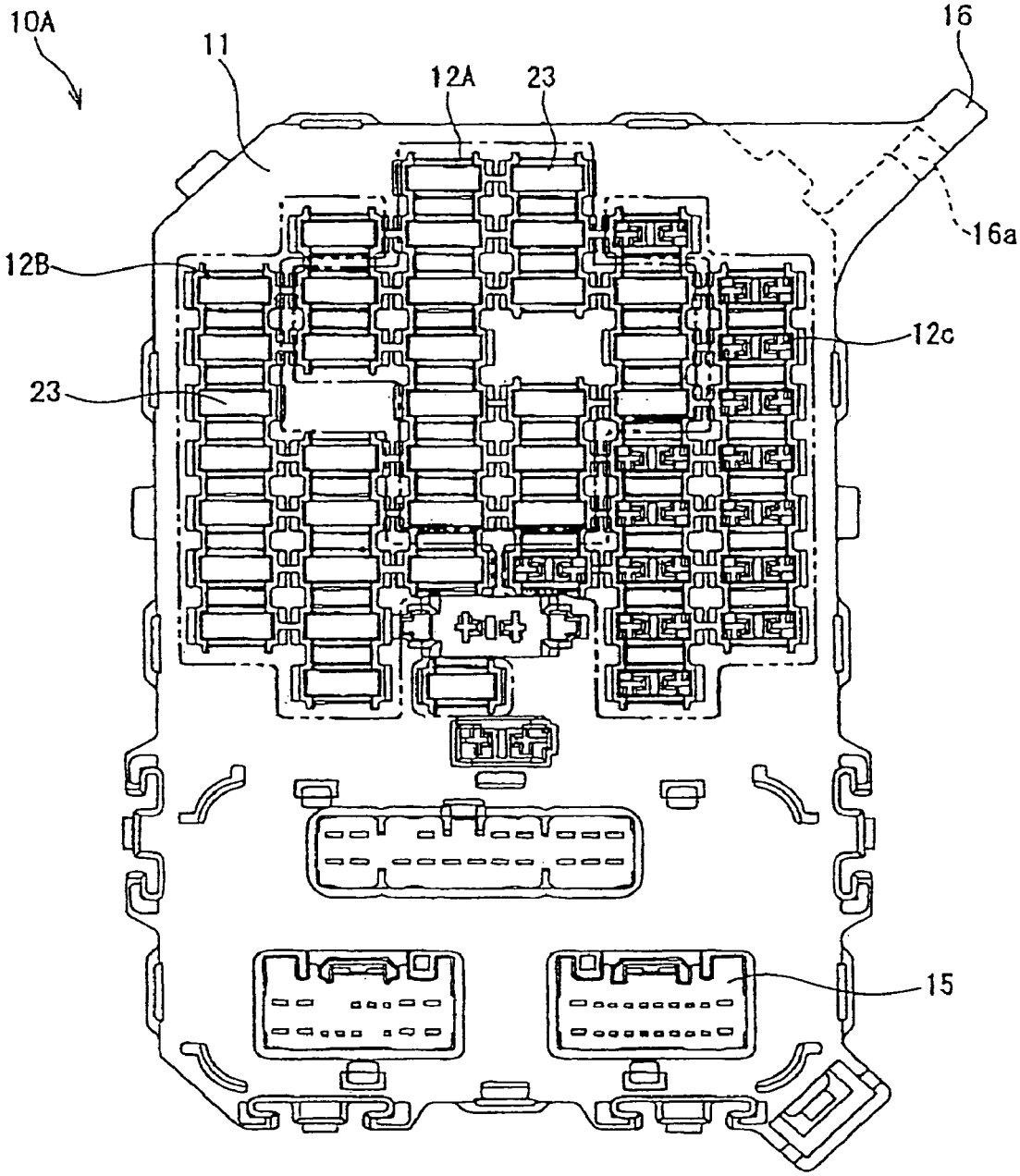
FIG. 4 is a plan view showing a condition in which fuses are mounted in fuse-mounting portions of an electric junction box for installation in a right hand drive vehicle.
Figure 5:
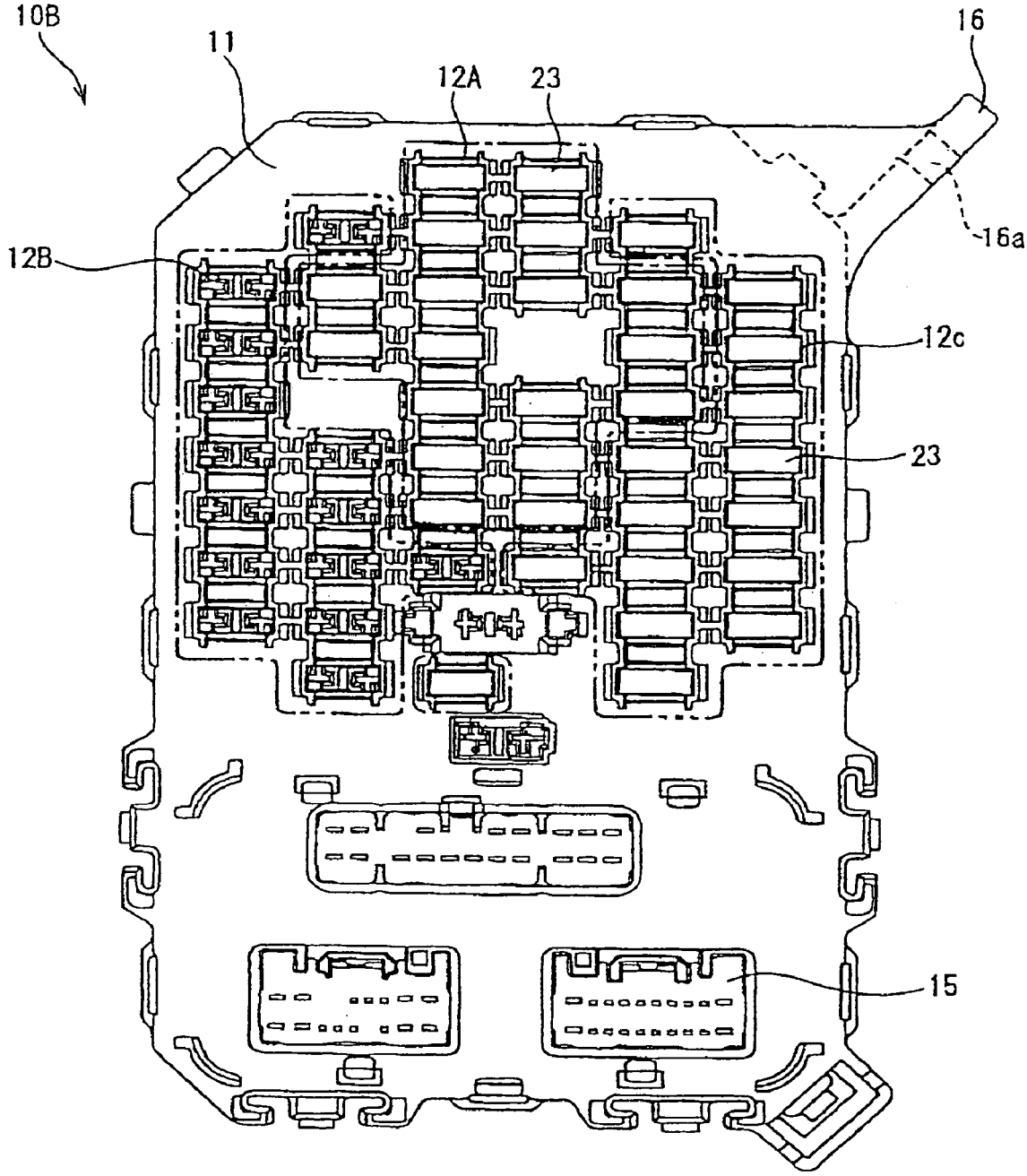
FIG. 5 is a plan view showing a condition in which fuses are mounted in fuse-mounting portions of an electric junction box for installation in a left hand drive vehicle.

As shown in FIG. 4, in electric junction box 10A for installation in a right hand drive vehicle, fuses 23 are mounted in fuse-mounting portions 13 of fuse-connecting units of the first group, which includes shared fuse-connecting units 12A and fuse-connecting units 12B for a right hand drive vehicle. On the other hand, as shown in FIG. 5, in electric junction box 10B for installation in a left hand drive vehicle, fuses 23 are mounted in fuse-mounting portions 13 of fuse-connecting units of the second group, which includes shared fuse-connecting units 12A and fuse-connecting units 12C for a left hand drive vehicle. In electric junction box 10A for installation in a right hand drive vehicle, there are no fuses mounted in fuse-mounting portions 13 of fuse-connecting units 12C for a left hand drive vehicle; and in electric junction box 10B for installation in a left hand drive vehicle, there are no fuses mounted in fuse-mounting portions 13 of fuse-connecting units 12B for a right hand drive vehicle.

Figure 6A:
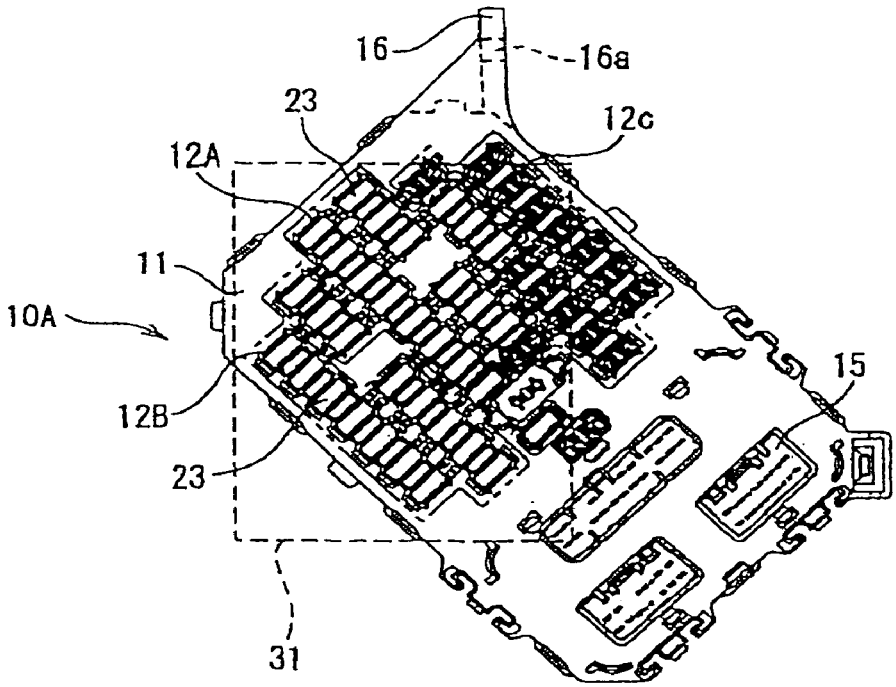
FIG. 6A shows relative locations between the electric junction box of FIG. 2 and a fuse-replacement opening in which the electric junction box is installed in a right hand drive vehicle.
Figure 6B:
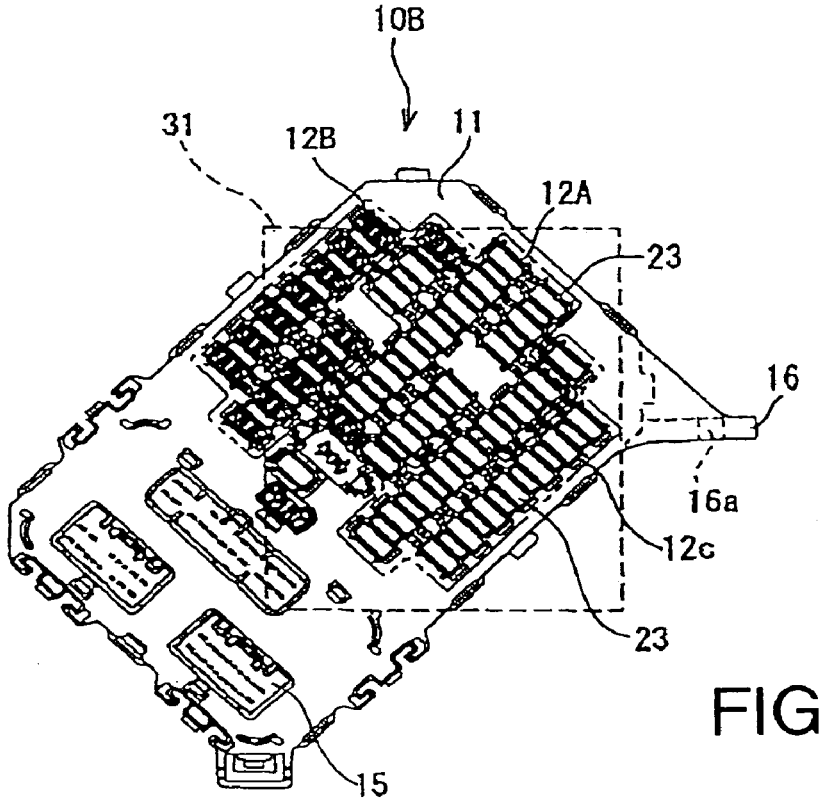
FIG. 6B shows relative locations between the electric junction box of FIG. 2 and a fuse-replacement opening in which the electric junction box is installed in a left hand drive vehicle.

As described above, when electric junction box 10A having fuses 23 mounted in the fuse-connecting units of the first group is bolted to a body panel (not shown in the figures) of a right hand drive vehicle, the fuse-connecting units of the first group are located in alignment with fuse-replacement opening 31 formed on panel 30, as shown in FIG. 6A. On the other hand, when electric junction box 10B having fuses 23 mounted in the fuse-connecting units of the second group is bolted to a body panel (not shown in the figures) of a left hand drive vehicle, the fuse-connecting units of the second group are located in alignment with fuse-replacement opening 31 formed on panel 30, as shown in FIG. 6B.

According to the configuration described above, by providing shared fuse-connecting units 12A, fuse-connecting units 12B for a right hand drive vehicle, and fuse-connecting units 12C for a left hand drive vehicle on upper case 11 of electric junction box 10, it is possible to replace fuses 23 mounted in required fuse-connecting units through fuse-replacement opening 31 formed on panel 30, whether the electric junction box 10 is mounted on a right hand drive vehicle or a left hand drive vehicle. Consequently, electric junction box 10 can be used in both a right hand drive vehicle and a left hand drive vehicle, and there is no need to provide separate electric junction boxes specific for a right hand drive vehicle and an electric junction box, thereby making it possible to reduce the number of parts.

Figure 7:
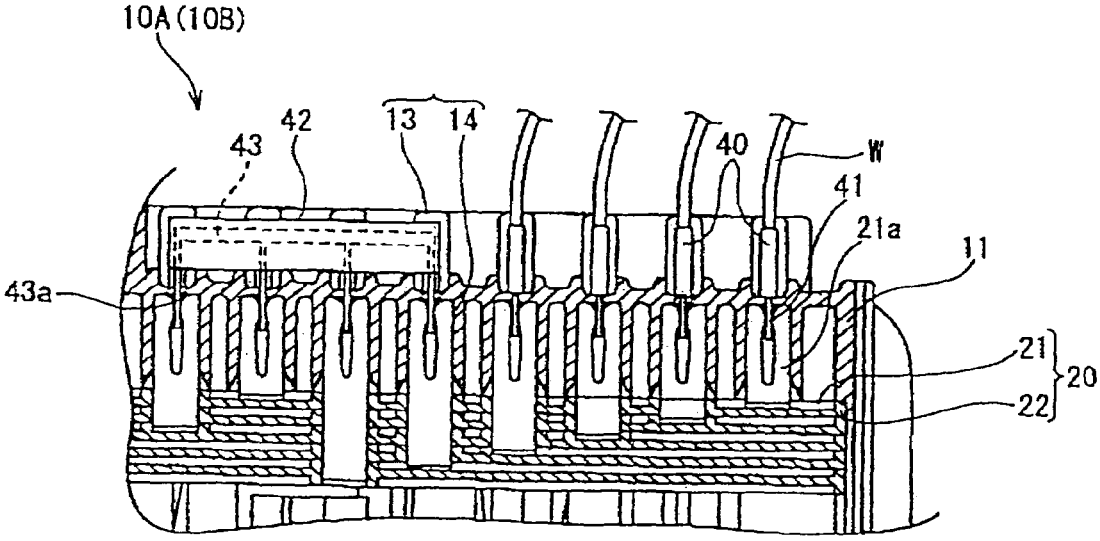
FIG. 7 is a cross-sectional view of fuse-connecting units of an electric junction box according to a second embodiment of the present invention.
Figure 8:
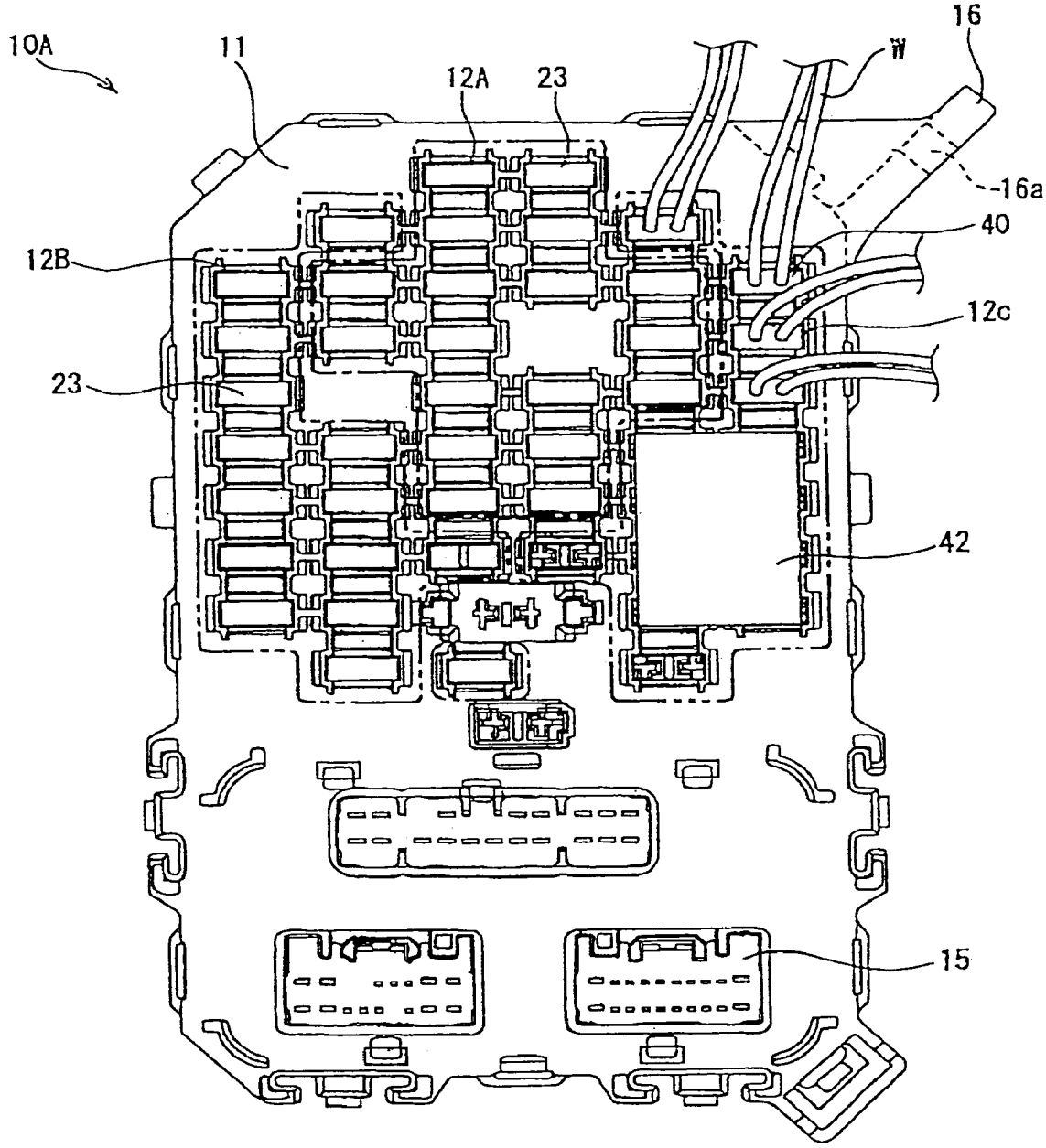
FIG. 8 is a plan view showing a condition in which fuses, fuse connectors, and joint connectors are mounted in fuse-mounting portions of the electric junction box of FIG. 7 for installation in a right hand drive vehicle.
Figure 9:
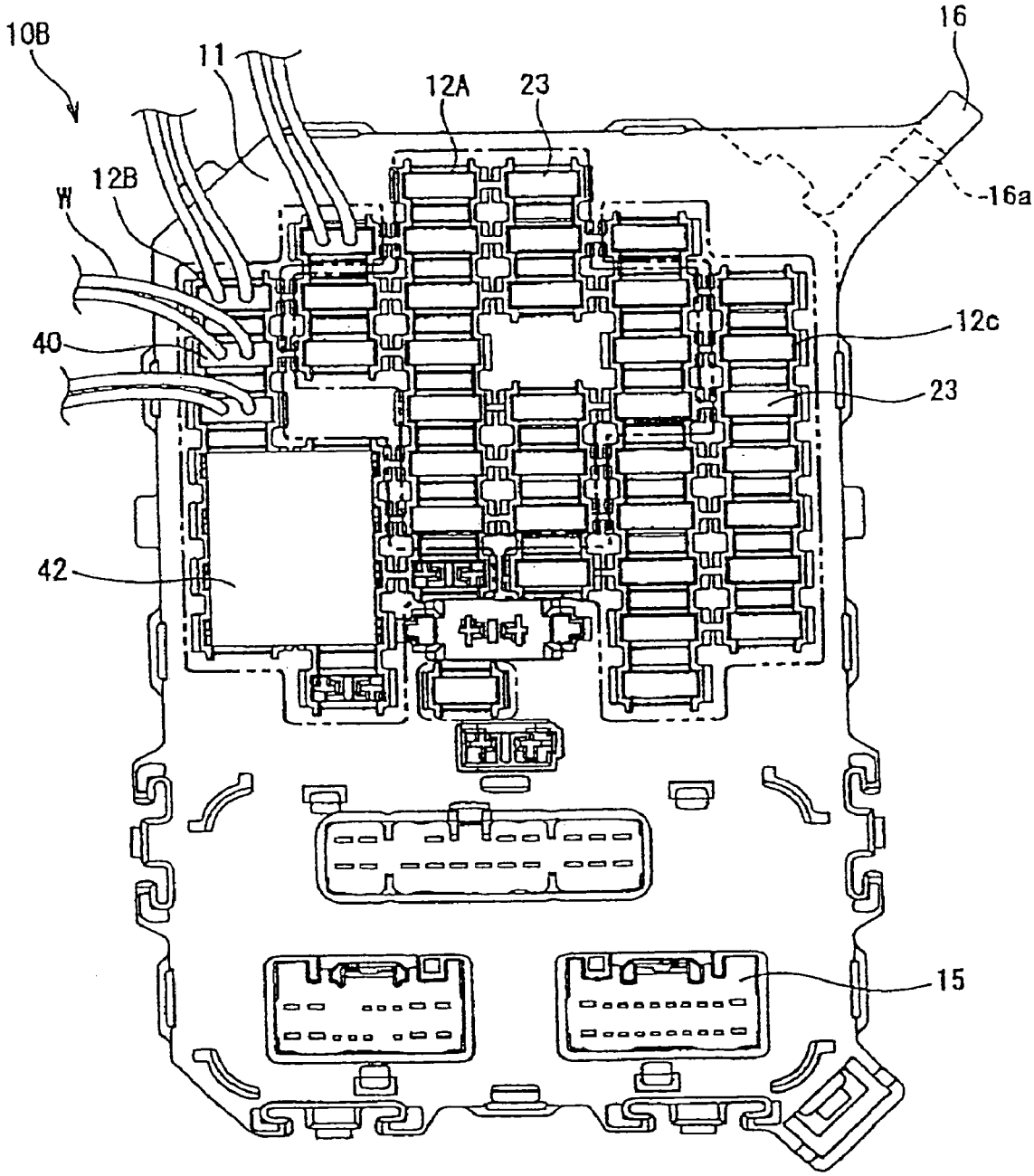
FIG. 9 is a plan view showing a state in which fuses, fuse connectors and joint connectors are mounted in fuse-mounting portions of the electric junction box of FIG. 7 for installation in a left hand drive vehicle.

The second embodiment of the present invention is shown in FIGS. 7–9. Electric junction box 10 of the second embodiment is the same as electric junction box 10 in the first embodiment, in that the electric junction box 10 of the second embodiment can be used in both a right hand drive vehicle and a left hand drive vehicle. In the second embodiment, in electric junction box 10A for installation in a right hand drive vehicle, fuse connectors 40 and joint-connectors 42 are mounted in fuse-connecting units 12C for a left hand drive vehicle. And, in electric junction box 10B for installation in a left hand drive vehicle, fuse connectors 40 and joint-connectors 42 are mounted in fuse-connecting units 12B for a right hand drive vehicle.

Fuse connector 40 is a bipolar connector having electric wires w connected to input and output terminals 41. Electric wires w are pulled out from a through-hole formed on the upper surface of a case of fuse connector 40. Joint-connector 42 includes a joint bus bar 43 inside the case of the joint connector 42. Joint bus bar 43 has a plurality of branched projecting connection pins 43*a*. Connection pins 43*a* project out from the lower surface of the case of the joint connector 42, as shown in FIG. 7.

When fuse connectors 40 and joint connectors 42 are mounted in fuse-mounting portions 13 of electric junction box 10, in which no fuses have been mounted, as shown in FIG. 7, input and output terminals 41 of fuse connectors 40 are connected to fuse-connecting terminals 21*a* of the internal circuit so that the internal circuit is connected to an external circuit; and connection pins 43*a* of joint-connectors 42 are connected to fuse-connecting terminals 21*a* so that bus bars 21 are connected via joint bus bars 43.

According to the configuration described above, by fitting fuse connectors 40 into fuse-connecting units 12C for a left hand drive vehicle in electric junction box 10A for installation in a right hand drive vehicle or into fuse-connecting units 12B for a right hand drive vehicle in electric junction box 10B for installation in a left hand drive vehicle, fuse-connecting terminals 21*a* are connected to electric wires w of an external circuit. Similarly, by fitting joint-connectors 42 into fuse-connecting units 12C for a left hand drive vehicle in electric junction box 10A for installation in a right hand drive vehicle or into fuse-connecting units 12B for a right hand drive vehicle in electric junction box 10B for installation in a left hand drive vehicle, fuse-connecting terminals 21*a* can be connected to each other to form a different circuit. Therefore, fuse-connecting terminals 21*a* that are not used to connect input and output terminals 24 of fuses 23 can be used effectively.

Figure 10:
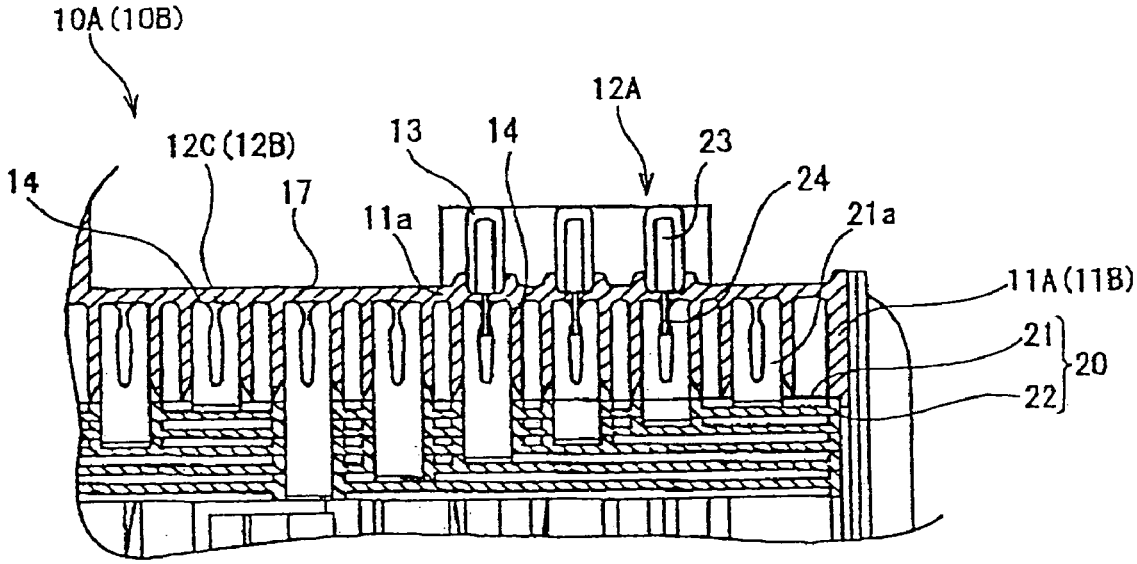
FIG. 10 is a cross-sectional view of fuse-connecting units of an electric junction box according to a third embodiment of the present invention.
Figure 11B:
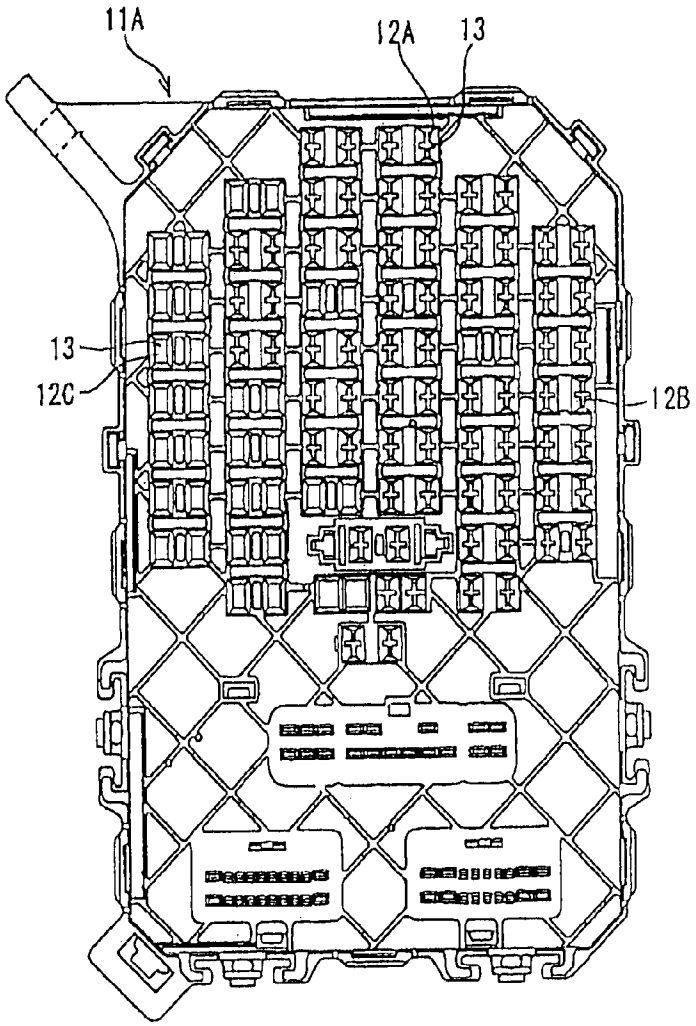
FIG. 11B is bottom plan view of an upper case of the electric junction box of FIG. 10 for installation in a right hand drive vehicle.
Figure 11A:
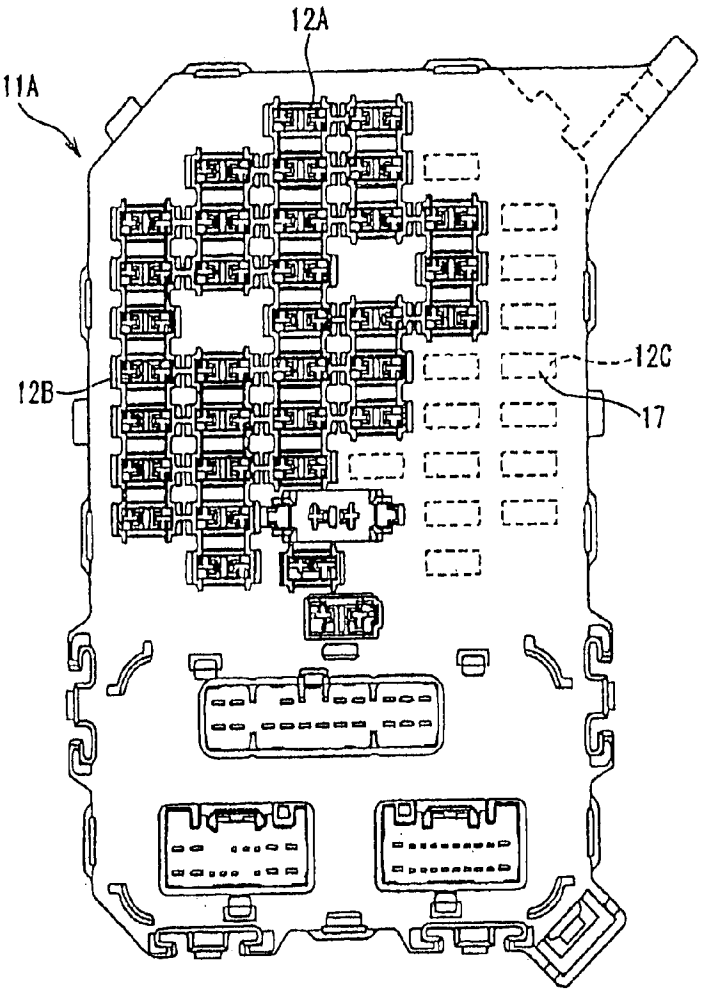
FIG. 11A is a plan view of an upper case of the electric junction box of FIG. 10 for installation in a right hand drive vehicle.
Figure 12B:
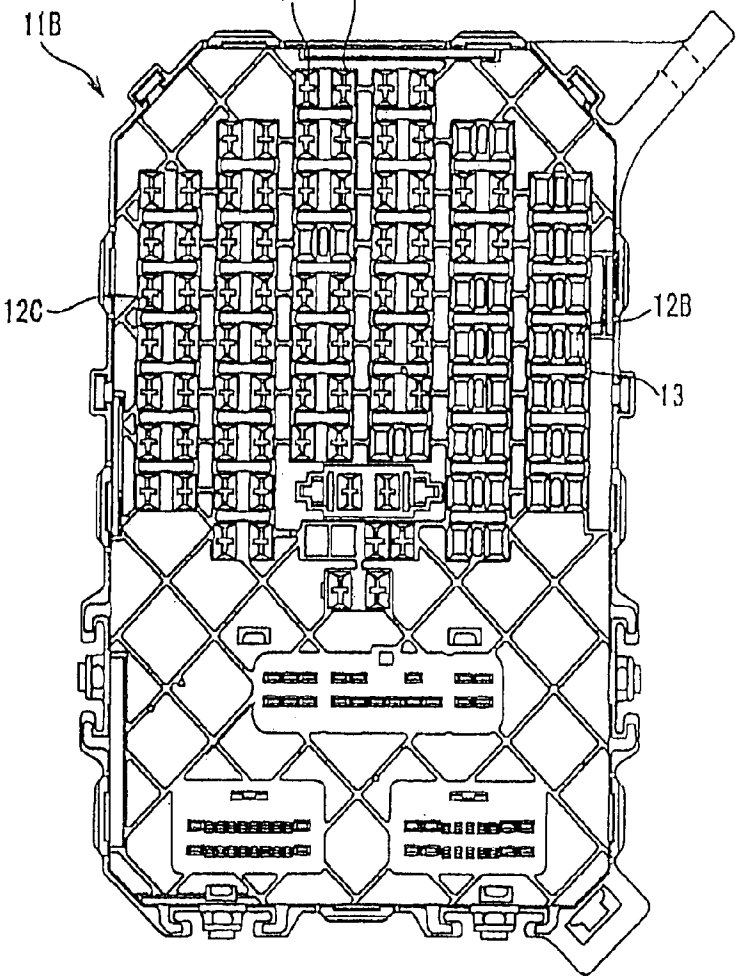
FIG. 12B is a bottom plan view of an upper case of the electric junction box of FIG. 10 for installation in a left hand drive vehicle.
Figure 12A:
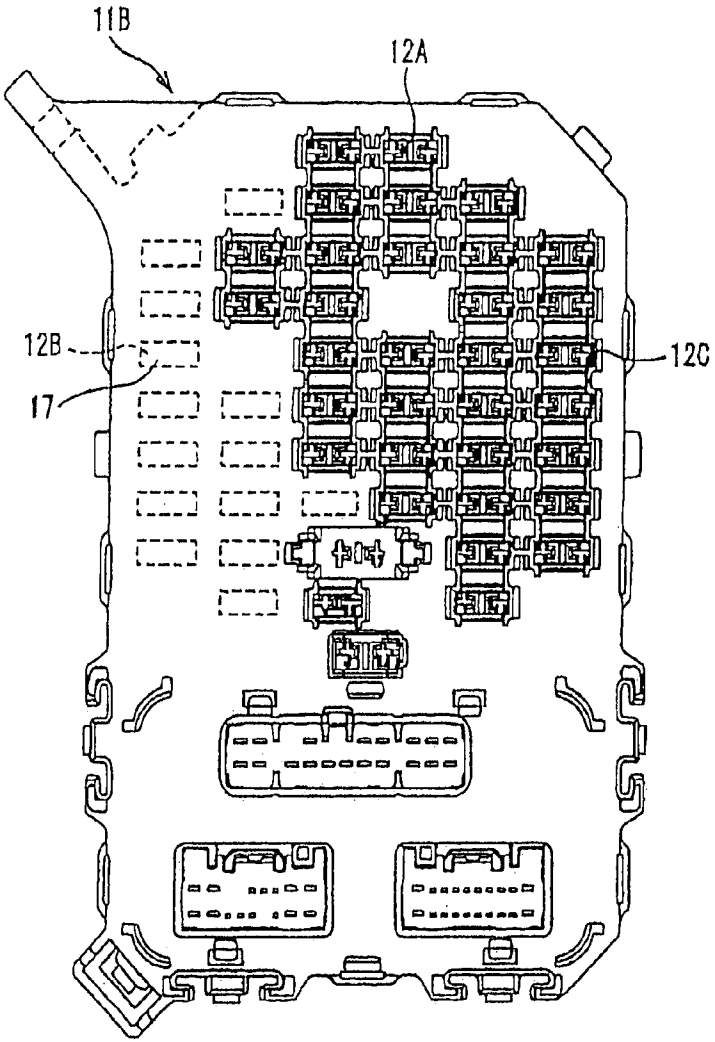
FIG. 12A is a plan view of an upper case of the electric junction box of FIG. 10 for installation in a left hand drive vehicle.
Figure 13A:
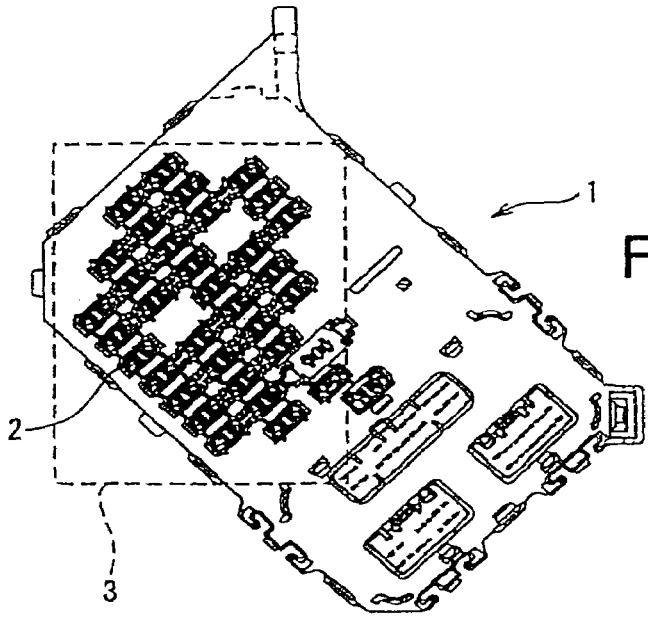
FIG.13A PRIOR ART
FIG. 13A shows a conventional electric junction box for right hand drive vehicles installed in a right hand drive vehicle.
Figure 13B:
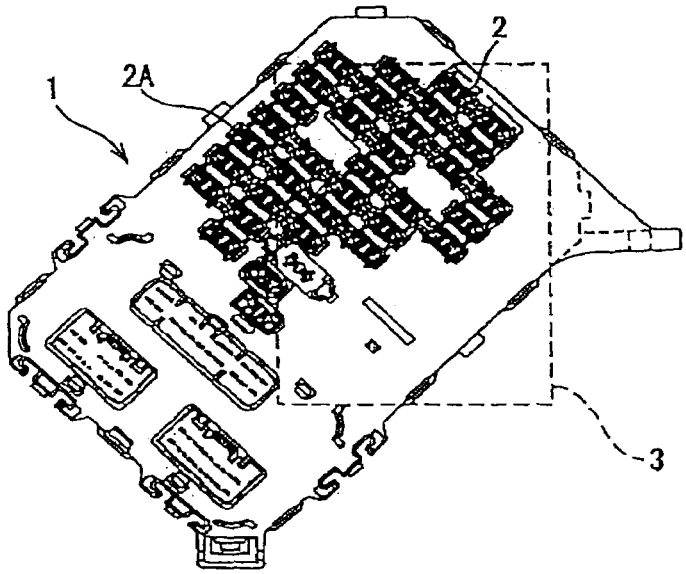
FIG.13B PRIOR ART
FIG. 13B shows a conventional electric junction box for right hand drive vehicles installed in a left hand drive vehicle.

The third embodiment of the present invention is shown in FIGS. 10–12. In the third embodiment, fuse-connecting units 12 differ somewhat from the first embodiment. In particular, electric junction box 10A for installation in a right hand drive vehicle is the same as in the first embodiment in that each of shared fuse-connecting units 12A and fuse-connecting units 12B for a right hand drive vehicle is formed by a fuse-mounting portion 13 provided on the external surface and a fuse-connecting terminal receptacle 14 on the inner surface of upper wall 11*a* of upper case 11A. However, each of fuse-connecting units 12C for a left hand drive vehicle is formed by only fuse-connecting terminal receptacle 14 provided on the inner surface of upper wall 11; on the external surface of upper wall 11*a*, fuse-mounting portion 13 is not provided, instead, a closed surface 17 is formed. Similarly, in electric junction box 10B for installation in a left hand drive vehicle, shared fuse-connecting units 12A and fuse-connecting units 12C for a left hand drive vehicle on upper case 11B are the same as in the first embodiment. However, each of fuse-connecting units 12B for a right hand drive vehicle is formed by only fuse-connecting terminal receptacle 14 provided on the inner surface of upper wall 11*a*; on the external surface of upper wall 11*a*, fuse-mounting portion 13 is not provided, instead, a closed surface 17 is formed.

According to the configuration described above, among fuse-connecting units 12B for a right hand drive vehicle and fuse-connecting units 12C for a left hand drive vehicle, those fuse-connecting units that are not used have no fuse-mounting portions 13 and are closed. Therefore, it is possible to prevent fitting fuse 23 in fuse-connecting unit 12C specific for a left hand drive vehicle in electric junction box 12A for installation in a right hand drive vehicle, or to prevent fitting fuse 23 in fuse-connecting unit 12B specific for a right hand drive vehicle in electric junction box 12B for installation in a left hand drive vehicle. Further, on the inner surface of upper case 11A and inner surface of upper case 11B, fuse-connecting terminal receptacles 14 are provided for all fuse-connecting units 12. Therefore, there is no need to change the internal circuit for a right hand drive vehicle and a left hand drive vehicle. Except upper case 11, the electric junction box can be used in both a right hand drive vehicle and a left hand drive vehicle.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention and in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. An electric junction box for a right hand drive vehicle or a left hand drive vehicle, said electric junction box comprising:

a case; and a plurality of fuse-connecting units provided on said case, said plurality of fuse-connecting units comprising:

shared fuse-connecting units provided in a middle region of said case among said plurality of fuse-connecting units;

fuse-connecting units for a right hand drive vehicle; and fuse-connecting units for a left hand drive vehicle;

wherein fuse replacements are performed through a fuse-replacement opening in the vehicle, the fuse-replacement opening in a right hand drive vehicle and the fuse-replacement opening in a left hand drive vehicle having the same shape and being provided at locations symmetrical left to right;

wherein said fuse-connecting units in a right hand drive vehicle are provided in alignment with the fuse-replacement opening only when said electric junction box is provided in a right hand drive vehicle.

2. An electric junction box for a right hand drive vehicle or a left hand drive vehicle, said electric junction box comprising:

a case; and a plurality of fuse-connecting units provided on said case, said plurality of fuse-connecting units comprising:

shared fuse-connecting units provided in a middle region of said case among said plurality of fuse-connecting units;

fuse-connecting units for a right hand drive vehicle; and fuse-connecting units for a left hand drive vehicle;

wherein fuse replacements are performed through a fuse-replacement opening in the vehicle, the fuse-replacement opening in a right hand drive vehicle and the fuse-replacement opening in a left hand drive vehicle having the same shape and being provided at locations symmetrical left to right;

wherein said fuse-connecting units in a left hand drive vehicle are provided in alignment with the fuse-replacement opening only when the electric junction box is provided in a left hand drive vehicle.

3. An electric junction box for a right hand drive vehicle or a left hand drive vehicle, said electric junction box comprising:

a case; and a plurality of fuse-connecting units provided on said case, said plurality of fuse-connecting units comprising:

shared fuse-connecting units provided in a middle region of said case among said plurality of fuse-connecting units;

fuse-connecting units for a right hand drive vehicle; and fuse-connecting units for a left hand drive vehicle;

wherein fuse replacements are performed through a fuse-replacement opening in the vehicle, the fuse-replacement opening in a right hand drive vehicle and the fuse-replacement opening in a left hand drive vehicle having the same shape and being provided at locations symmetrical left to right;

wherein said fuse-connecting units in a right hand drive vehicle and said fuse-connecting units in a left hand drive vehicle are provided symmetrically left to right with respect to said shared fuse-connecting units located in the middle region; and the number (A) of the shared fuse-connecting units and the number (B) of fuse-connecting units in either a right hand drive vehicle or a left hand drive vehicle are such that the ratio A:B is in the range 5:5–7:3.

4. An electric junction box for a right hand drive vehicle or a left hand drive vehicle, said electric junction box comprising:

a case; and a plurality of fuse-connecting units provided on said case, said plurality of fuse-connecting units comprising:

shared fuse-connecting units provided in a middle region of said case among said plurality of fuse-connecting units;

fuse-connecting units for a right hand drive vehicle; and fuse-connecting units for a left hand drive vehicle;

wherein fuse replacements are performed through a fuse-replacement opening in the vehicle, the fuse-replacement opening in a right hand drive vehicle and the fuse-replacement opening in a left hand drive vehicle having the same shape and being provided at locations symmetrical left to right;

wherein the combination of the shared fuse-connecting units and the fuse-connecting units in a right hand drive vehicle forms a first group of fuse-connecting units required for a right hand drive vehicle; and the combination of the shared fuse-connecting units and the fuse-connecting units in a left hand drive vehicle forms a second group of fuse-connecting units required for a left hand drive vehicle;

wherein all fuse-connecting terminals of an internal circuit contained inside said case project into all fuse-connecting terminal receptacles of the fuse-connecting units of the first group and the second group, the fuse-connecting terminal receptacles being provided on the inner surface of the case;

fuse-mounting portions are provided on the external surface of the case and are each linked to a corresponding fuse-connecting terminal receptacle;

for a right hand drive vehicle, said fuse-mounting portions are provided only for the shared fuse-connecting units and the fuse-connecting units in a right hand drive vehicle, and are not provided for the fuse-connecting units in a left hand drive vehicle so that the corresponding area on the external surface of said case forms a closed surface; and for a left hand drive vehicle, the fuse-mounting portions are provided only for the shared fuse-connecting units and the fuse-connecting units in a left hand drive vehicle, and are not provided for the fuse-connecting units in a right hand drive vehicle so that the corresponding area on the external surface of said case forms a closed surface.

5. An electric junction box for a right hand drive vehicle or a left hand drive vehicle, said electric junction box comprising:

a case; and a plurality of fuse-connecting units provided on said case, said plurality of fuse-connecting units comprising:

shared fuse-connecting units provided in a middle region of said case among said plurality of fuse-connecting units;

fuse-connecting units for a right hand drive vehicle; and fuse-connecting units for a left hand drive vehicle;

wherein fuse replacements are performed through a fuse-replacement opening in the vehicle, the fuse-replacement opening in a right hand drive vehicle and the fuse-replacement opening in a left hand drive vehicle having the same shape and being provided at locations symmetrical left to right;

wherein the combination of the shared fuse-connecting units and the fuse-connecting units in a right hand drive vehicle forms a first group of fuse-connecting units required for a right hand drive vehicle; and the combination of the shared fuse-connecting units and the fuse-connecting units in a left hand drive vehicle forms a second group of fuse-connecting units required for a left hand drive vehicle;

wherein all fuse-connecting terminals of an internal circuit contained inside said case project into all fuse-connecting terminal receptacles of the fuse-connecting units of the first group and the second group, the fuse-connecting terminal receptacles being provided on the inner surface of the case;

fuse-mounting portions are provided for all fuse-connecting units of the first group and the second group on the external surface of the case and are linked to the fuse-connecting terminal receptacles, respectively; and fuse connectors and/or joint-connectors are mounted in the fuse-mounting portions for a left hand drive vehicle when the junction box is for installation in a right hand drive vehicle or in the fuse-mounting portions for a right hand drive vehicle when the junction box is for installation in a left hand drive vehicle, each of the fuse connectors having electric wires connected to input and output terminals of a fuse, each of the joint-connectors including a joint bus bar, the joint bus bar having branched projecting connection pins, each of the connection pins connecting to a fuse-connecting terminal.

* * * * *